United States Patent [19]

Kling

[11] Patent Number: 4,761,583

[45] **Date of Patent: * Aug. 2, 1988**

[54] GLOW DISCHARGE STARTER CONTAINING RADIOACTIVE ALLOY

[75] Inventor: Michael R. Kling, Williamsport, Pa.

[73] Assignee: GTE Products Corporation, Danvers, Mass.

[ * ] Notice: The portion of the term of this patent subsequent to Feb. 24, 2004 has been disclaimed.

[21] Appl. No.: 890,685

[22] Filed: Jul. 30, 1986

[51] Int. Cl.[4] ..... H01J 65/08; H01H 61/00

[52] U.S. Cl. ..... 313/54; 313/619; 337/22; 337/27

[58] Field of Search ..... 313/54, 619, 637, 643, 313/622, 633, 562, 559, 558, 553; 337/22, 25, 27, 26

[56] References Cited

U.S. PATENT DOCUMENTS 2,324,907 7/1941 Clack .

2,824,985 12/1953 Foulke ..... 313/54

4,646,049 2/1987 Kling et al. ..... 337/27

4,646,050 2/1987 Kling et al. ..... 337/27

*Primary Examiner*—David K. Moore

*Assistant Examiner*—Michael Horabik

*Attorney, Agent, or Firm*—Carlo S. Bessone

[57] ABSTRACT

A glow discharge starter having an hermetically sealed envelope of vitreous material, a seal located at one end thereof and containing an ionizable medium. A pair of electrical conductors extend through the seal and terminate in a spaced relationship to form a pair of electrodes within the envelope. At least one of the electrodes has a bimetallic element secured thereto. A coating comprising lanthanum, nickel and at least one radioactive dopant is disposed on a surface within the envelope. The coating is sufficient to reduce the dark effect by improving the dark starting of the glow discharge starter.

21 Claims, 1 Drawing Sheet

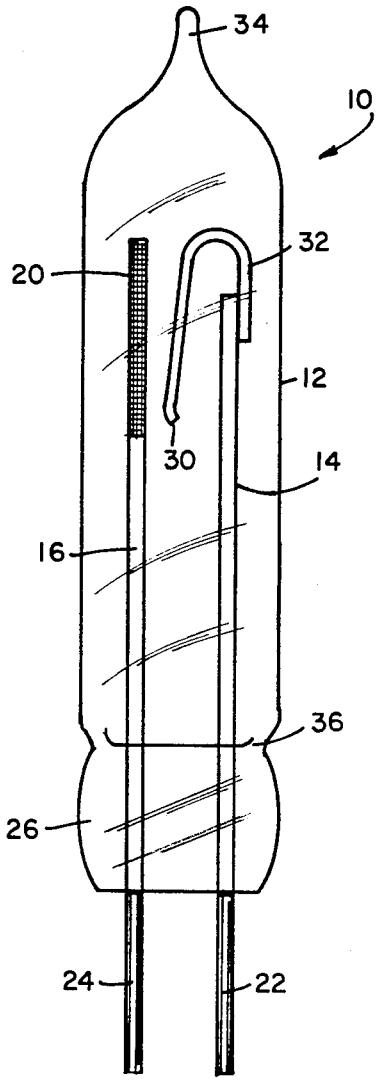
34
10
32
20
12
30
14
16
36
26
24
22

GLOW DISCHARGE STARTER CONTAINING RADIOACTIVE ALLOY

TECHNICAL FIELD

This invention relates in general to glow discharge starters for arc discharge lamps and more particularly to glow discharge starters containing a radioactive alloy coating of lanthanum, nickel and at least one radioactive dopant for improving dark starting.

BACKGROUND OF THE INVENTION

A glow discharge starter is usually connected across or in parallel with an arc discharge lamp and contains a pair of electrodes. At least one of the electrodes comprises a bimetallic element which, when heated as a result of the glow discharge, bends towards the other electrode. When contact is made, the glow discharge ceases causing the bimetallic element to cool and withdraw from the contacted electrode. When contact is broken, a voltage pulse induced by the induction of the ballast, appears across the opposed electrodes of the lamp thereby initiating an arc discharge within the lamp. If the lamp ignition does not occur after the first voltage pulse, the glow discharge starter sequence is repeated until lamp ignition occurs.

A glow discharge starter of the aforementioned type is described, for example, in the book "Light Sources" by Elenbaas, Philips Technical Library, pages 102–103.

Glow discharge starters are subject to an effect commonly known as dark effect, whereby the breakdown voltage of the glow discharge in the starter is higher in the dark than in the light after a period of non-operation. The above-mentioned effect results in delay at starting and erratic operation.

Several methods are known for reducing the dark effect in glow discharge starters. For example, U.S. Pat. No. 2,332,809, which issued to Peters on Oct. 26, 1943, discloses the use of a coating of a conductive material such as aluminum paint on the inner end of the stem and extending onto the lead-in wires at the points where they emerge from the press.

Other methods employing radioactive materials to help minimize or completely eliminate dark effect are also known. For example, U.S. Pat. No. 2,324,907, which issued to Clack on July 20, 1943, and U.S. Pat. No. 2,740,861, which issued to Lake et al on Apr. 3, 1956, describe the use of a coating of uranium oxide on the inner surface of the end wall of the glass envelope. A still further attempt of U.S. Pat. No. 2,930,872, which issued to Lake on Mar. 29, 1960, teaches the introduction of a minute quantity of radioactive krypton 85 in addition to an impurity gas such as hydrogen, carbon dioxide or nitrogen. U.S. Pat. No. 2,930,873, which issued to Lake et al on Mar. 29, 1960, suggests introducing tritium and a carrier gas consisting of hydrogen into the gaseous filling of the glow discharge starter.

Thorium is also used as a radiation source effective in reducing the dark effect of glow discharge starters. One method of employing thorium can be seen in many commercially available glow discharge starters containing a getter holder centrally located at the end of the starter envelope remote from the stem press. The getter holder consists of a small piece of metal in which a cup is formed therein. The cup contains a getter mixture which, for example, may comprise barium, magnesium and a small amount of thorium. During fabrication and processing, the thorium-containing mixture within the cup of the getter holder is "flashed" onto the internal surface of the envelope and internal parts of the glow discharge starter. The approach of introducing thorium into the glow discharge starter by means of a getter holder is expensive due to the relatively high cost of the getter holders and the equipment necessary for flashing.

Disadvantages of the above attempts to neutralize the dark effect include, for instance, substantial increases in material and/or manufacturing costs, severe material licensing requirements in the case of the krypton 85. In the case of the aluminum stem paint, the effectiveness thereof decreases during the life of the glow discharge starter, thereby rendering the operation of the starter erratic and terminating its useful life.

The use of a lanthanum-nickel alloy in a glow discharge starter is a known method of providing a low work function emissive material necesssary to obtain proper breakdown voltage in some glow discharge starters. It has been discovered that by adding at least one radioactive dopant to a lanthanum-nickel alloy, the dark effect common to glow discharge starters can be reduced by improving the dark starting of the glow discharge starter. Normally, one would expect that a radioactive dopant such as uranium would not form a stable mixture with lanthanum because of the dopant's known low solubility in lanthanum. Furthermore, one would expect that the activity of the small radioactive material in a mixture would be greatly diminished by self absorption.

SUMMARY OF THE INVENTION

It is, therefore, an object of the invention to obviate the disadvantages of the prior art.

It is another object of the invention to provide an alternative means for reducing the dark effect of glow discharge starters.

It is still another object of the invention to provide a less expensive means of introducing a radioactive dopant into glow discharge starters.

These objects are accomplished, in one aspect of the invention, by the provision of a glow discharge starter comprising an hermetically sealed envelope of vitreous material having a seal located at one end thereof and containing an ionizable medium. A pair of electrical conductors extend through the seal and terminate in a spaced relationship to form a pair of electrodes within the envelope. At least one of the electrodes has a bimetallic element secured thereto. The bimetallic element is deformable by heat into engagement with the other electrode. A coating comprising lanthanum, nickel and at least one radioactive dopant is disposed on a surface within the envelope. Preferably, the coating is disposed on a portion of at least one of the electrodes. The coating is sufficient to reduce the dark effect by improving the dark starting of the glow discharge starter.

In accordance with further aspects of the present invention, the radioactive dopant is selected from the group consisting of uranium and thorium. In a preferred embodiment of the invention, the radioactive dopant is uranium and has a content equal to less than abut 10.0 percent of the coating. In another embodiment, the coating contains two radioactive dopants, preferably uranium and thorium.

In accordance with further aspects of the present invention, the electrical conductors are comprised of a nickel-iron alloy. In a preferred embodiment, they are comprised of a nickel-iron alloy coating with a layer of copper and plated with an electrically conductive material. Preferably, the electrically conductive material is selected from the group consisting of nickel, platinum and rhodium.

In accordance with still further teachings of the invention, the electrical conductors are comprised of "Dumet" or nickel-plated "Dumet".

In accordance with the teachings of the present invention, the envelope has a wall thickness in the range of from about 0.015 inch (0.380 millimmeter) to less than about 0.025 inch (0.635 millimeter). Preferably, the thin-walled envelope has an outside diameter of approximately 0.175 inch (4.445 millimeters). In a preferred embodiment, the glow discharge starter displaces a volume of approximately 0.25 cubic centimeters.

BRIEF DESCRIPTION OF THE DRAWING

The sole FIGURE is a front elevational view of an embodiment of a glow discharge starter according to the invention.

BEST MODE FOR CARRYING OUT THE INVENTION

For a better understanding of the present invention, together with other and further objects, advantages and capabilities thereof, reference is made to the following disclosure and appended claims taken in conjunction with the above-described drawing.

Referring now to the drawing with greater particularlity there is shown in the sole FIGURE a glow discharge starter 10 in accordance with one embodiment of the invention. Glow discharge starter 10 is shown comprising an hermetically sealed, envelope 12 containing an ionizable medium of, for example, argon, helium and mixtures thereof at a pressure of from about 15 to 20 millimeters of mercury.

Preferably, envelope 12 has a wall thickness in the range of from about 0.015 inch (0.380 millimeter) to less than about 0.025 inch (0.635 millimeter). Envelope 12 can be made from, for example, G-10 lead glass, G-12 lead glass or lime glass. The above-mentioned glasses are available from Corning Glass Works, Corning, N.Y. A seal 26 (e.g., press seal) is located at one end of envelope 12. An exhaust tip 34 is located at the other end of envelope 12.

A pair of electrical conductors 22 (e.g., non-segmented) and 24 extend through seal 26 and terminate in a spaced relationship to form a pair of electrodes 14 and 16, respectively, within envelope 12. A suitable material for electrical conductors 22 and 24 (and corresponding electrode post 14 and electrode 16) is a nickel-iron alloy, such as Niron 52 available from GTE Precision Materials Group, Warren, Pa. Alternatively, the electrical conductors may consist of a nickel-iron alloy core sheathed in a copper shell. An example of such a material is sold under the trade name "Dumet" and consists of a nickel-iron core having a copper sleeve. The copper sleeve constitutes 21 to 25 percent of the total weight of the material and is usually affixed about the nickel-iron core by swagging, welding, molten dipping, etc. Such wire is especially effective for developing glass-to-metal seals. Generally, heat is applied to the glass and to the "Dumet" which, in turn, serves as a bridge between the metal and the glass and insures the desired glass-to-metal seal. Alternatively, electrical conductors 22 and 24 may comprise a nickel-iron alloy core sheathed in a copper shell plated with an electrically conductive material selected from the group consisting of nickel, platinum and rhodium. Specifically, nickel-plated "Dumet" wire having a diameter in the range of from about 0.010 inch (0.254 millimeter) to about 0.025 inch (0.635 millimeter) is preferred because of the relatively low cost as compared with other metal-plated wires.

Electrode 14 has a bimetallic element 32 secured at one end thereof. Bimetallic element 32 is bent over into a U-shape, as shown in the sole FIGURE, so that the free end 30 thereof is proximate electrode 16. Bimetallic element 32 consists of two strips of metal having different linear coefficients of expansion welded together. The side of higher coefficient of expansion is on the inside curve of the U so that bimetallic element 32, when heated by the glow discharge, opens and engages electrode 16. The free end 30 of bimetallic element 32 may be provided with an outwardly projecting embossment of curved poriton (not shown) to insure that contact with electrode 16 is always made at the same point after flexure of bimetallic element 32 through a predetermined distance.

Alternatively, electrode 16 can be constructed as a second bimetallic electrode (i.e., have a bimetallic element secured thereto) as shown, for example, in previously mentioned U.S. Pat. No. 2,930,873.

In accordance with the teachings of the present invention, a coating 20 is disposed on a surface within envelope 12 of glow discharge starter 10 to reduce the dark effect by improving the dark starting of the glow discharge starter. Coating 20, which comprises lanthanum, nickel and at least one radioactive dopant, can be located, for example, on a portion of the internal wall of the envelope or on a portion of at least one of the electrodes. In the sole FIGURE, coating 20 is shown covering a portion of electrode 16. Alternatively, the radioactive coating can be applied to electrode 14, bimetallic element 32 or to the internal surface of envelope 12. Preferably, the radioactive dopant is selected from the group consisting of uranium and thorium. More than one radioacive dopant can be added to the lanthanum-nickel alloy, such as uranium and thorium. Preferably, the radioactive content of the radioactive material is not greater than about 10.0 percent of the total weight of the coating.

The radioactive alloy coating not only provides a low work function emissive material for obtaining a proper breakdown voltage, but also reduces the dark effect by improving the dark starting of the glow discharge starter.

EXAMPLE 1

In a typical but non-limitative example of a glow discharge starter made in accordance with the invention, the envelope 12 was made from G-12 lead glass having a wall thickness of about 0.016 inch (0.406 millimeter) and an outside diameter of approximately 0.175 inch (4.445 millimeters). A pair of nickel-plated "Dumet" electrical conductors 22, 24 with a diameter of approximately 0.020 inch (0.508 millimeter) extend through a press seal 26 located at one end of the envelope and terminate within the envelope to form a pair of electrodes 14, 16. The substantially parallel electrodes are spaced approximately 0.060 inch (1.524 millimeters) from each other. The distance from exhaust tip 34 to the top 36 of stem press 26 was approximately 0.660 inch (16.764 millimeters). A bimetallic element 32 having a width of approximately 0.063 inch (1.6 millimeters), an overall length of approximately 0.320 inch (8.128 millimeters) and a thickness of approximately 0.004 inch (0.102 millimeter) ws bent over into a U-shape and welded to electrode 39 within envelope 12. A suitable material for bimetallic element 32 is designated as type B1 and is available from Texas Instruments, Attleboro, Mass. A portion of the other electrode 16 was dipped in a molten alloy having a composition of about 83.8% La-11.4%Ni-5.0%U. Suitable radioactive alloys are specially prepared and available from Research Chemicals, Phoenix, Ariz. The envelope 12 contained an ionizable medium of 25 percent helium-75 percent argon at a pressure of approximately 18 millimeters of mercury. The glow discharge starter 10 displaced a volume of approximatly 0.25 cubic centimeters.

EXAMPLE II

In another typical but non-limitative example of a glow discharge starter made in accordance with the invention, the envelope 12 was made from G-12 lead glass having a wall thickness of about 0.016 inch (0.406 millimeter) and an outside diameter of approximately 0.175 inch (4.445 millimeters). A pair of nickel-plated "Dumet" electrical conductors 22, 24 with a diameter of approximately 0.020 inch (0.508 millimeter) extend through a press seal 26 located at one end of the envelope and terminate within the envelope to form a pair of electrodes 14, 16. The substantially parallel electrodes are spaced approximately 0.060 inch (1.524 millimeters from each other. The distance from exhaust tip 34 to the top 36 of stem press 26 was approximately 0.660 inch (16.764 millimeters). A bimetallic element 32 having a width of approximately 0.063 inch (1.6 millimeters), an overall length of approximately 0.320 inch (8.128 millimeters) and a thickness of approximately 0.004 inch (0/102 millimeter) was bent over into a U-shape and welded to electrode 39 within envelope 12. A portion of the other electrode 16 was dipped in a molten alloy having a composition of about 68.5% La-22.4%Ni-9.1%U to provide a low work function emissive material 20. The envelope 12 contained an ionizable medium of 25 percent helium- 75 percent argon at a pressure of approximately 18 millimeters of mercury. The glow discharge starter 10 displaced a volume of approximately 0.25 cubic centimeters.

Samples of glow discharge starters made similar to those in the above two examples were tested with similarly constructed glow discharge starters having electrode 16 dipped instead in a molten alloy having a composition of about 85.0% La:15.0% Ni. The latter control group did not have a radioactive dopant in the lanthanum-nickel coating. Testing was accomplished by enclosing the glow discharge starters in a light-tight metal enclosure. After a 24 hour period of non-operation, 108 volts, 60 cycles were applied to the glow discharge starters. Table I below shows the average time required for glow current to begin to flow after application of voltage along with the percentage of glow discharge starters starting in under 10 seconds and under 60 seconds.

TABLE I

| Starter Coating | Avg. Time to Glow (secs.) | % of Starter Starting ≦10 secs. | <60 secs. |
|---|---|---|---|
| 83.8% La—11.4% Ni—5.0% U | 18.4 | 42.0 | 92.0 |
| 68.5% La—22.4% Ni—9.1% U | 9.4 | 65.0 | 100.0 |
| 85.0% La—15.0% Ni | 44.8 | 20.0 | 33.0 |

Table I above clearly shows the improvement in dark starting performance of glow discharge starters made in accordance with the teachings of the present invention. Glow discharge starters having a uranium content of about 5.0 percent and about 9.1 percent began to glow in 58.9 percent and 79.0 percent less time, respectively, than starters without a radioactive dopant. Table I also shows that a coating of lanthanum, nickel and at least one radioactive dopant greatly increases the amount of glow discharge starters starting within a predetermined amount of time.

While there have been shown and described what are at present considered to be the preferred embodiments of the invention, it will be apparent to those skilled in the art that various changes and modifications can be made herein without departing from the scope of the invention as defined by the appended claims.

I claim:

1. A glow discharge starter comprising: an hermetically sealed envelope of vitreous material having a seal located at one end thereof and containing an ionizable medium; a pair of electrical conductors extending through said seal and terminating in a spaced relationship to form a pair of electrodes within said envelope, at least one of said electrodes having a bimetallic element secured thereto, said bimetallic element being deformable by heat into engagement with the other of said electrodes; and a coating comprising lanthanum, nickel and at least one radioactive dopant disposed on a surface within said envelope, said coating being sufficient to reduce the dark effect by improving the dark starting of said glow discharge starter.

2. The glow discharge starter of claim 1 wherein said radioactive dopant is selected from the group consisting of uranium and thorium.

3. The glow discharge starter of claim 1 wherein said radioactive dopant is uranium.

4. The glow discharge starter of claim 3 wherein said uranium has a content not greater than about 10.0 percent of said coating.

5. The glow discharge starter of claim 3 wherein said content of said uranium is about 9.1 percent of said coating.

6. The glow discharge starter of claim 3 wherein said content of said uranium is about 5.0 percent of said coating.

7. The glow discharge starter of claim 1 wherein said coating contains two radioactive dopants.

8. The glow discharge starter of claim 7 wherein said two radioactive dopants are uranium and thorium.

9. The glow discharge starter of claim 1 wherein said coating is disposed on a portion of at least one of said electrodes.

10. The glow discharge starter of claim 1 wherein said electrical conductors are comprised of a nickel-iron alloy.

11. The glow discharge starter of claim 1 wherein said electrical conductors are comprised of a nickel-iron alloy core having a copper shell.

12. The glow discharge starter of claim 11 wherein said electrical conductors are plated with an electrically conductive material.

13. The glow discharge starter of claim 12 wherein said electrically conductive material is selected from the group consisting of nickel, platinum and rhodium.

14. The glow discharge starter of claim 1 wherein said electrical conductors are "Dumet".

15. The glow discharge starter of claim 1 wherein said electrical conductors are nickel-plated "Dumet".

16. The glow discharge starter of claim 1 wherein said envelope has a wall thickness in the range of from about 0.015 inch to less than about 0.025 inch.

17. The glow discharge starter of claim 1 wherein said envelope has an outside diameter of approximately 0.175 inch.

18. The glow discharge starter of claim 1 wherein said envelope is glass.

19. The glow discharge starter of claim 1 wherein said glow discharge starter displaces a volume of approximately 0.25 cubic centimeters.

20. The glow discharge starter of claim 1 wherein said ionizable medium comprises a mixture of helium and argon.

21. The glow discharge starter of claim 20 wherein said ionizable medium comprises a mixture of about 25% helium and about 75% argon.

* * * * *